United States Patent [19]

Andersson

[11] 4,441,625

[45] Apr. 10, 1984

[54] PACKAGE HAVING A RESEALING DEVICE

[75] Inventor: Börje Andersson, Lund, Sweden

[73] Assignee: Robert Bosch GmbH, Stuttgart, Fed. Rep. of Germany

[21] Appl. No.: 319,501

[22] Filed: Nov. 9, 1981

[30] Foreign Application Priority Data

Nov. 18, 1980 [SE] Sweden ..... 8008063

[51] Int. Cl.[3] ..... B65D 51/20

[52] U.S. Cl. ..... 220/257; 220/410; 206/606

[58] Field of Search ..... 206/621, 606, 624, 622, 206/626; 220/257, 408, 410, 462, 256, 258; 229/55, 62, 65, 44 R, 43; 222/283, 541, 556, 565, 566

[56] References Cited

U.S. PATENT DOCUMENTS

| | | | |
|---|---|---|---|
| 685,900 | 11/1901 | Anderson | 206/621 X |
| 3,055,568 | 9/1962 | Zalkind | 220/462 X |
| 3,089,622 | 5/1963 | Westlake | 222/183 |
| 3,599,840 | 8/1969 | Speas | 222/183 |

FOREIGN PATENT DOCUMENTS

| | | |
|---|---|---|
| 1486395 | 12/1973 | Fed. Rep. of Germany . |
| 2443721 | 3/1975 | Fed. Rep. of Germany . |
| 2046484 | 8/1978 | Fed. Rep. of Germany . |
| 2813598 | 2/1981 | Fed. Rep. of Germany . |
| 927866 | 6/1963 | United Kingdom . |

*Primary Examiner*—Steven M. Pollard
*Assistant Examiner*—David Voorhees
*Attorney, Agent, or Firm*—Edwin E. Greigg

[57] ABSTRACT

A package having a resealable device for oxygen-sensitive products is in which the package is gas-tight and convenient to use. The package has an envelope sealed in a gas-tight manner, an outer container surrounding the envelope, and a resealable device. The resealing device, comprising a rigid frame and a cap fitting into the frame, is secured with its frame close to the top wall within the envelope. The top wall is removable by means of a tear strip. At the level of the resealable device, the outer container has a tear strip for removing its top wall.

11 Claims, 15 Drawing Figures

FIG. 4
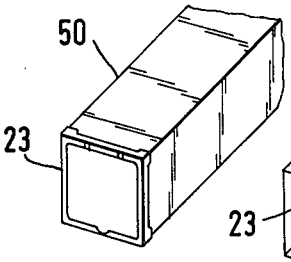
FIG. 5
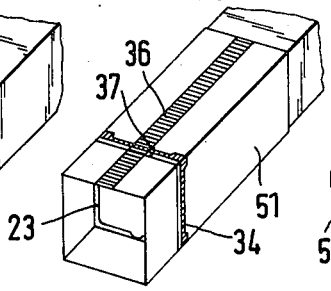
FIG. 6
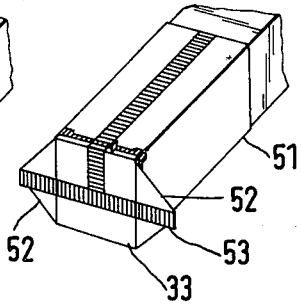
FIG. 7
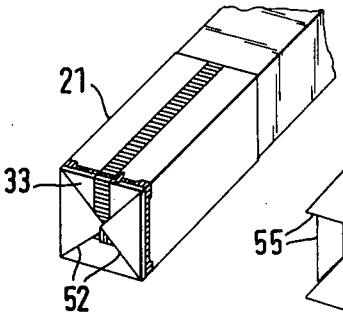
FIG. 8
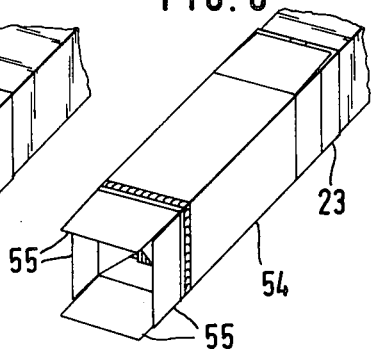
FIG. 9
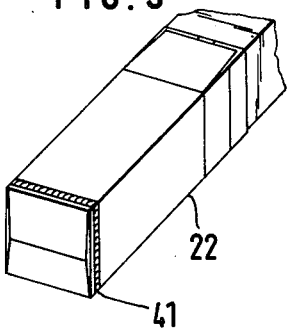
FIG. 10
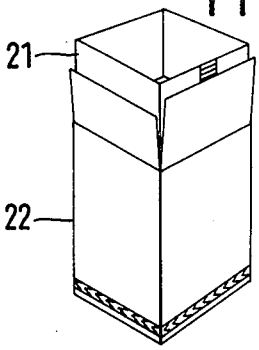
FIG. 11
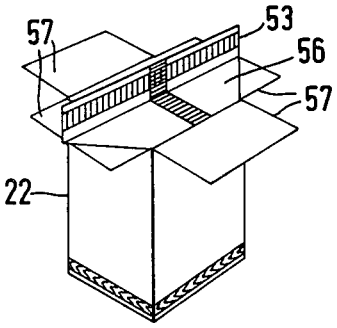
FIG. 12
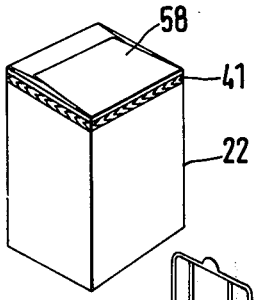
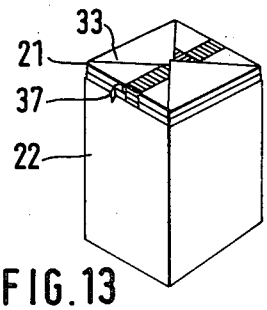
FIG. 13
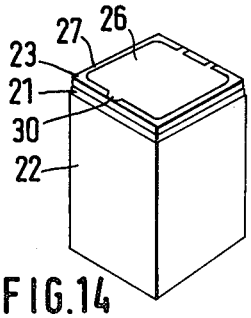
FIG. 14
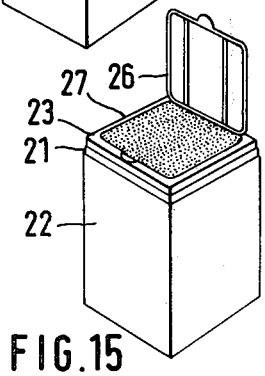
FIG. 15

PACKAGE HAVING A RESEALING DEVICE

BACKGROUND OF THE INVENTION

The invention is based on a package having a resealing device. A package container is already known from German Auslegeschrift No. 14 86 395, in which a resealing device comprising a cap and a frame is inserted in the mouth of the container. However, resealing devices of this kind are not gas-tight, so that the container cannot be used for packaging oxygen-sensitive products such as coffee, milk powder and so forth. It has accordingly been proposed that the cap be covered with a cover sheet releasably sealed onto the frame. This arrangement is very labor-intensive, however, and does not afford sufficient reliability in terms of the tightness required of such a container. It is also quite difficult to secure the frame of the resealing device in the mount of the container in a gas-tight manner. Of itself, the known package is quite convenient to use, but taken overall, it is not capable of reliably providing the gas-tightness required for packaging highly valuable products.

A package comprising a gas-tight envelope and an outer container having a resealing device has also become known, for instance from German Offenlegungsschrift No. 24 43 721. However, in this package the resealing device is disposed outside the envelope, on the outer container, and forms a closure with the outer container. In this disposition of the resealing device, the cap of the package may be bumped or pushed and accordingly damaged. Furthermore, disposing the resealing device in this manner cannot provide a very dust-tight package.

Accordingly, a package is desired which is reliably gas-tight, whose resealing device is dust-tight to a great extent and which is convenient to use.

OBJECT AND SUMMARY OF THE INVENTION

The package according to the invention has the advantage over the prior art that its tightness with respect to gas and dust in similar to that of metal cans, yet the energy required to produce such a package is substantially less. There is also no danger that the contents will be spilled when the container is opened.

A further advantage is that none of the packaged product sticks to the part of the envelope that is removed, because this part does not come into contact with the contents of the package.

The package according to the invention is convenient, especially when the user first opens it, because a tear strip is disposed on the envelope above the line where the resealing device is secured. When the package according to the invention is thus equipped, no extra tools, such as a knife, are needed when opening the package for the first time.

As a result of the characteristics disclosed, advantageous modifications of and improvements to the package disclosed are attainable.

The invention will be better understood and further objects and advantages thereof wil become more apparent from the ensuing detailed description of a preferred embodiment taken in conjunction with the drawings.

BRIEF DESCRIPTION OF THE DRAWINGS

FIGS. 4–12 show the various steps in producing the package according to FIG. 1; and FIGS. 13–15, in perspective views, show various steps taken upon first opening the package of FIG. 1.

DESCRIPTION OF THE PREFERRED EMBODIMENT

Figure 1:
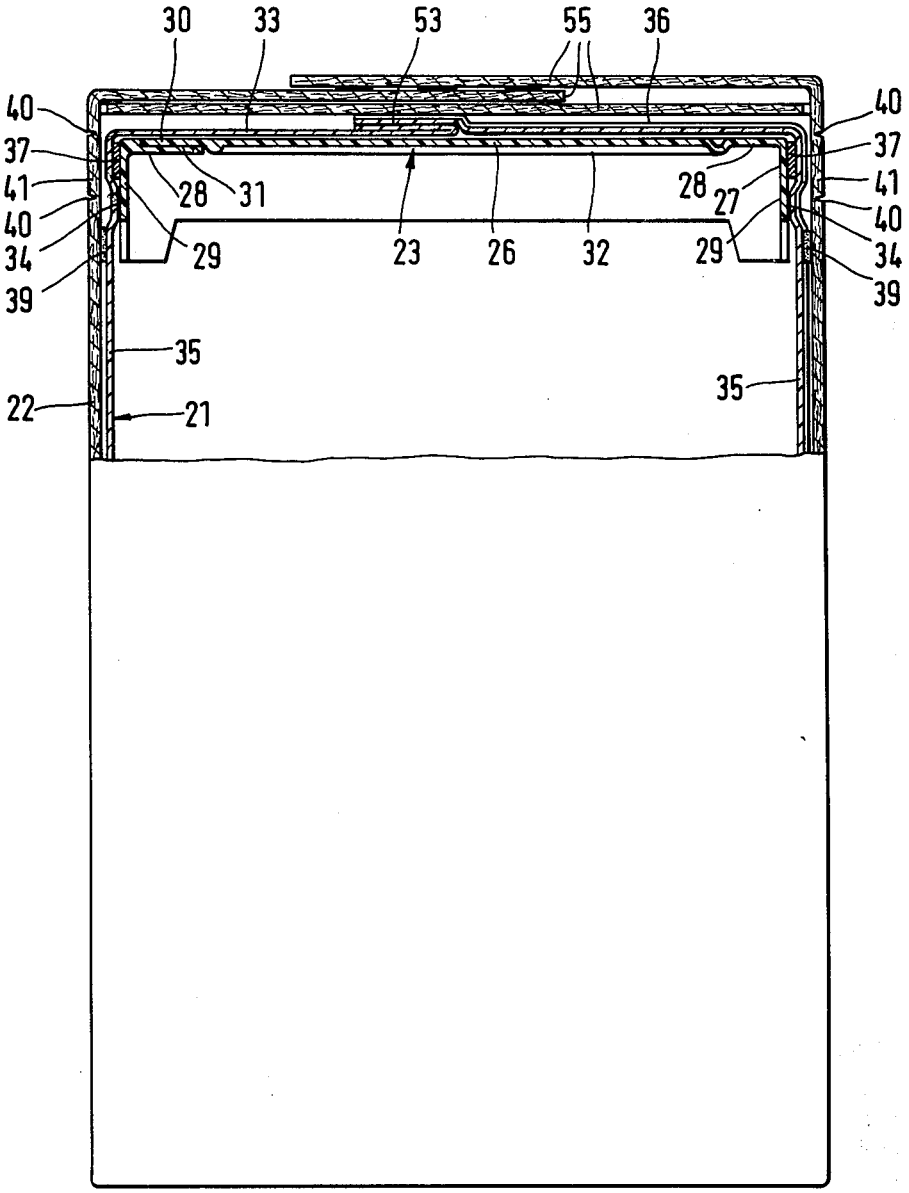
FIG. 1 shows a package in cross section in simplified form.

The package shown in the drawings has the shape of a building block and substantially comprises an envelope 21 receiving the product, an outer container 22 surrounding the envelope 21 and a resealing device 23. The envelope is fabricated by folding and sealing a packaging material having the particular characteristics of being gas-tight and vapor-proof. This may be a multilayered material such as paper/polyethylene, polyester-/aluminum polyethylene or the like; the polyethylene layer is on the inside and is heatsealable.

Figure 2:
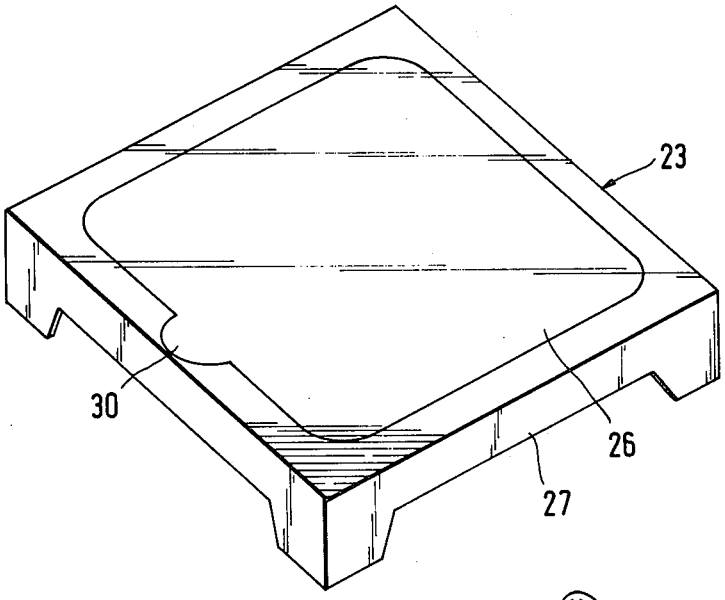
FIG. 2 is a perspective view of a resealing device.
Figure 3:
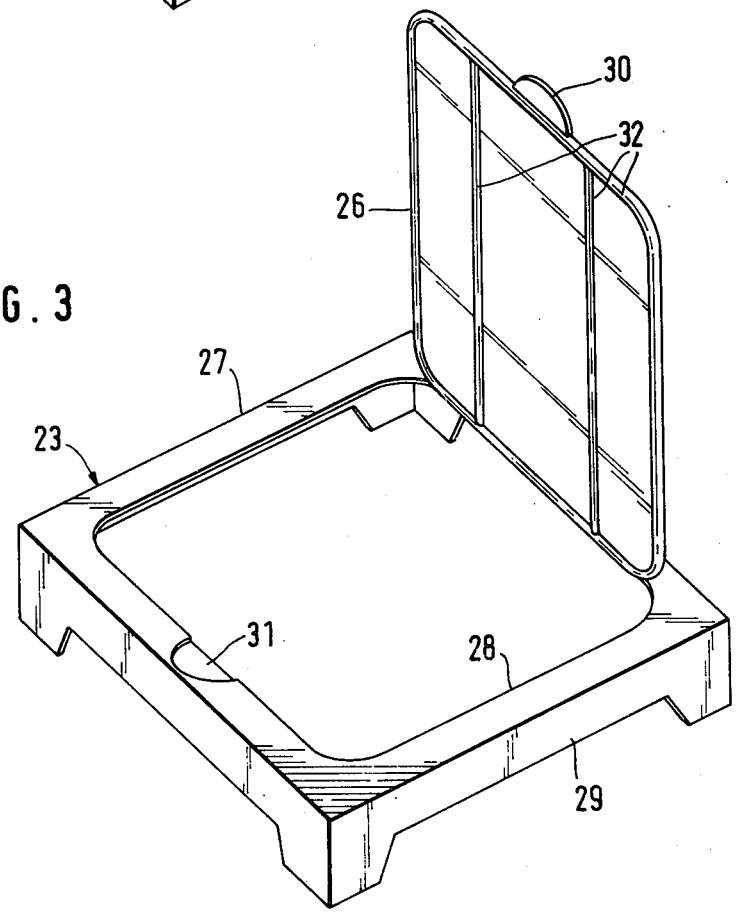
FIG. 3 is a perspective view of the resealing device of FIG. 2 when open.

The resealing device 23 (FIGS. 2 and 3) disposed in the envelope 21 comprises a cap 26 and a frame 27. The cap 26 and frame 27 are fabricated in one piece, by mold casting or thermoforming, from a thermoplastic synthetic, such as polyethylene or polypropylene. The cap 26 is connected with the frame 27 in hingelike fashion at one rim (FIG. 3). On the rim opposite the connecting rim, the cap 26 has a protruding grip tab 30, which is associated with a corresponding recess 31 in the frame 27. The cap 26 also has reinforcement ribs 32 on its underside. When closed, the cap 26 engages the frame 27 and seals it in a dust-tight manner (FIG. 2). The rigid frame 27 has an L-shaped cross section, the horizontal arm 28 of which cooperates with the cap 26 to form a seal, and the upright arm 29 of which is secured on the inside of the envelope 21. The resealing device 23 is disposed in the upper part of the envelope 21 such that the cap 26 and the horizontal arm 28 of the frame 27 rest on the top inner wall of the envelope 21, and the upright arm 29 of the frame 27 is welded to the four side walls 35 of the envelope 21 by a suitable seam 34 which passes all the way around the frame 27 approximately halfway up the upright arm 29.

Above the welding seam 34, a tear strip 37 passing all the way around is sealed to the inside of the side walls 35 of the envelope 21. The tear strip 37 has one end which protrudes outwardly through the longitudinal seam 36 of the envelope 21 (FIG. 13).

The outer container 22 surrounding the envelope 21 is made of cardboard. This container is fastened to the envelope 21 by adhesive points 39, located approximately at the level of the lower part of the upright arm 29 of the frame 27. The adhesive points 39 are preferably provided by heat sealing. Above the adhesive points 39, perforation lines 40 are punched into the outer container 22 and define a tear strip 41.

The package described above is preferably fabricated on a machine which has a plurality of shaping mandrels; these pass through a plurality of processing stations, as follows:

First, the resealing device 23 is placed upon the end face of a shaping mandrel 50 in such a manner that the upright arms 29 of the frame 27 engage the walls of the shaping mandrel 50 (FIG. 4). At a second station, a sheet of packaging material is folded around the shaping mandrel 50 to make a sheath 51, and its longitudinal edges are welded to the longitudinal seam 36 of the envelope (FIG. 5). The tear strip 37 has previously been welded onto the sheet of packaging material such that one end of the sheet of packaging material protrudes beyond one rim so that this end protrudes out of the longitudinal seam 36. Simultaneously with the welding of the longitudinal seam 36, the sheath 51 is welded around all sides to the upright arms 29 of the frame 27 (welding seam 34). The portion of the sheath 51 protruding beyond the resealing device 23 is thereupon flattened, folded onto the resealing device 23 (creating triangular offstanding flaps 52) and tightly sealed by means of a transverse welding seam 53, so that this part forms the top wall 33 described above (FIG. 6). The flaps 52, which at first are located in the same plane as the top wall 33, are folded over onto the top wall 33 (FIG. 7).

A precut piece of cardboard is folded around the envelope 21 thus formed (which is still mounted on the shaping mandrel 50), and shaped into a sheath 54 (FIG. 8). The adhesive points 39 have previously been applied to the transverse strip which comes into a position where it overlaps the upright arm 29 of the frame 27, and these adhesive points 39 fasten the sheath 54 firmly to the envelope 21. The top folding flaps 55 of the precut cardboard, which have also been glued, are then folded over the top wall 33 of the envelope and glued together (FIG. 9).

The empty packaging container thus formed is then removed from the shaping mandrel 50 and is set in place such that the closure of the container which has been provided on one end temporarily serves as the base of the container (FIG. 10). In this position, the container is filled. After the envelope 21 has been filled, its open end is tightly sealed and folded to make a bottom wall 56. The bottom folding flaps 57 of the precut cardboard are also folded onto the bottom wall 56 of the envelope 21 and glued together to form a top wall 58 of the outer container 22. The package is then turned, so that its top, with the top walls 33 and 58 and the resealing device 23, is located at the top (FIG. 12).

The package thus fabricated may be opened as follows:

First the tear strip 41 of the outer container 22 defined by the perforation lines 40 is removed by tearing, and the top wall 58 of the outer container 22 is removed (FIG. 13), so that the top wall 33 of the envelope 21 is exposed. Then the user grasps the protruding end of the tear strip 37 and, by pulling on it, separates the top wall 33 of the envelope 21 from the side walls of the envelope. After the top wall 33 has been removed, the package is ready for repeated opening and resealing. By grasping the grip tab of the cap 26, the cap 26 is swung upward. After a portion of the packaged product has been removed, the cap 26 is pressed back into the frame 27, where it is seated in a dust-tight manner. The package can thus be opened and resealed repeatedly and can also be stacked conveniently.

It is further noted that the advantages discussed at the outset above are also provided even in a package which has no outer container 22.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A package comprising a gas-tight, flexible three-dimensional envelope having opposite end areas and side walls forming an interior and a resealable device at one of said end areas and disposed within the interior of said envelope, said resealable device including a rigid frame assembly including side walls affixed to the interior of said side walls of said envelope and a resealable cap engaging said rigid frame, characterized in that said envelope has top wall tightly covering said resealable device in a gas-tight condition with a portion of said side walls of said frame juxtaposed a tear strip carried by said envelope which tear strip removes the top wall of said envelope from the side walls of said envelope to expose said resealable cap.

2. A package as defined by claim 1, characterized in that said envelope is surrounded by an outer container of rigid packaging material, said envelope and said container being connected by means of a plurality of adhesive points positioned beneath said tear strips on said envelope.

3. A package as defined by claim 1, characterized in that said container is provided with a tear strip.

4. A package as defined by claim 3, characterized in that said tear strip in said container overlies said tear strip in said envelope.

5. A package comprising a gas-tight, flexible three-dimensional envelope having opposite end areas and side walls and a resealable device at one of said end areas of said envelope, said resealable device including a rigid frame assembly affixed to said side walls of said envelope and a resealable cap engaging said frame, said resealing device comprising the frame and said cap being fabricated in one piece, said cap and frame being connected to one another in hingelike fashion and said envelope has a top wall tightly covering said resealing device.

6. A package as defined by claim 5, characterized in that said resealing device is mold cast of a synthetic material which is heat-sealable to said envelope.

7. A package comprising a gas-tight, flexible three-dimensional envelope having opposite end areas and side walls forming an interior and a resealable device at one of said end areas and disposed within the interior of said envelope, said resealable device including a rigid frame assembly including side walls affixed to said side walls of said envelope and a resealable cap engaging said rigid frame, said frame and said cap being fabricated in one piece, and said envelope has a top wall tightly covering said resealable device with a portion of said side walls of said frame juxtaposed a tear strip carried by said envelope which tear strip removes the top wall of said envelope from the side walls of said envelope to expose said resealable cap.

8. A package as defined by claim 7, characterized in that said resealable device is mold cast of a synthetic material which is heat-sealable to said envelope.

9. A package as defined by claim 7, characterized in that said envelope is surrounded by an outer container of rigid packaging material, said envelope and said container being connected by means of a plurality of adhesive points positioned beneath said tear strips on said envelope.

10. A package as defined by claim 7, characterized in that said container is provided with a tear strip.

11. A package as defined by claim 10, characterized in that said tear strip in said container overlies said tear strip in said envelope.

* * * * *